US006101344A

United States Patent [19]

Ishibashi

[11] Patent Number: 6,101,344

[45] Date of Patent: Aug. 8, 2000

[54] ELECTROSTATIC IMAGING DEVICE CAPABLE OF PRODUCING HIGH-QUALITY IMAGE DESPITE VARIATIONS IN AMBIENT CONDITIONS

[75] Inventor: Junichi Ishibashi, Niigata, Japan

[73] Assignee: NEC Corporation, Tokyo, Japan

[21] Appl. No.: 09/198,844

[22] Filed: Nov. 24, 1998

[30] Foreign Application Priority Data

Nov. 28, 1997 [JP] Japan ..... 9-328537

[51] Int. Cl.[7] ..... G03G 15/00; G03G 15/16

[52] U.S. Cl. ..... 399/66; 399/44

[58] Field of Search ..... 399/66, 88, 89, 399/43–45, 313, 314

[56] References Cited

U.S. PATENT DOCUMENTS

| | | | |
|---|---|---|---|
| 5,646,717 | 7/1997 | Hiroshima et al. | 399/154 |
| 5,887,220 | 3/1999 | Nagaoka | 399/46 |
| 5,893,661 | 4/1999 | Sakai et al. | 399/66 |
| 5,953,556 | 9/1999 | Yamanaka | 399/66 |

FOREIGN PATENT DOCUMENTS

| | | |
|---|---|---|
| 4-168465 | 6/1992 | Japan . |
| 5-100534 | 4/1993 | Japan . |
| 5-307305 | 11/1993 | Japan . |
| 5-313515 | 11/1993 | Japan . |
| 6-118814 | 4/1994 | Japan . |
| 6-161294 | 6/1994 | Japan . |
| 6-161295 | 6/1994 | Japan . |
| 7-225505 | 8/1995 | Japan . |
| 8-220816 | 8/1996 | Japan . |
| 8-240957 | 9/1996 | Japan . |

*Primary Examiner*—Joan Pendegrass
*Attorney, Agent, or Firm*—Ostrolenk, Faber, Gerb & Soffen, LLP

[57] ABSTRACT

An electrostatic imaging device such as a printer or facsimile machine has a power source for a transcription roller for transcribing a toner image from a photoreceptor drum to a recording sheet. The power source applies to the transcription roller during an initialization period a power source having a first characteristic between a transcription voltage (V) and a transcription current (I) defined by I/a+V/b=1. The transcription voltage and the transcription current are measured, based on which the power source selects one of a plurality of characteristics of a power source to be applied to the transcription roller during an operation period.

7 Claims, 3 Drawing Sheets

ELECTROSTATIC IMAGING DEVICE CAPABLE OF PRODUCING HIGH-QUALITY IMAGE DESPITE VARIATIONS IN AMBIENT CONDITIONS

BACKGROUND OF THE INVENTION (a) Field of the Invention

The present invention relates to an electrostatic imaging device such as a printer and a facsimile machine using an electrophotographic technique, and more particularly, to an electrostatic imaging device capable of obtaining a high-quality image regardless of the variation in ambient conditions. The present invention also relates to a method for forming an image in the electrostatic imaging device.

(b) Description of the Related Art

Conventional electrostatic imaging devices are described in JP-A-6(1994)-161294 (first publication) and JP-A-5-313515 (second publication), for example. In the electrostatic imaging device described in the first publication, a driving voltage calculator calculates a driving voltage based on the temperature data from a thermal sensor and the humidity data from a humidity sensor with reference to data stored in a ROM. An I/O controller transmits the calculated driving voltage data to a driver of an electrification unit, to control the transcribing potential to be supplied from the electrification unit to the transcribing roller based on the detected temperature and the detected humidity.

In the electrostatic imaging device described in the second publication, when the temperature and humidity within the device are detected by the temperature and humidity sensors and supplied to a CPU, the CPU judges which range in the first table data stored in the memory the detected temperature and the humidity reside. Then, the CPU reads the transcription current data and the voltage control data for removing an electric charge corresponding to the toner species of the transcribed toner image with reference to the second table data stored in the memory, thereby selecting the transcription current and the voltage control data for removing the electric charge.

As described above, the electrostatic imaging devices described in the above first and second publications determine a suitable transcription current for the ambient conditions based on the detected temperature and humidity. Accordingly, it is necessary in the prior art to examine the locations for the thermal and humidity sensors before fabrication of the device and determine the most suitable ambient conditions for transcription. This increases the number of the steps for designing the electrostatic imaging device and decreases the available design choices for the device.

SUMMARY OF THE INVENTION

It is therefore an object of the present invention to provide an electrostatic imaging device capable of suppressing any transcription error caused by variation of the ambient conditions without using temperature and humidity sensors and of increasing the number of design choices as well as decreasing the number of design steps.

It is another object of the present invention to provide a method of forming an image in the electrostatic imaging device.

The present invention provides, in one aspect thereof, an electrostatic imaging device comprising a photoreceptor drum for carrying thereon a toner layer having an electrostatic latent image, a transcription roller for transcribing the toner layer onto a recording sheet, a power source for providing a transcription voltage and a transcription current to the transcription roller, a voltmeter for measuring the transcription voltage, an ammeter for measuring the transcription current, a ROM for storing first data for a first characteristic between the transcription voltage and transcription current and second data for a plurality of second characteristics between the transcription voltage and the transcription current, the power source providing power to the transcription roller based on the first characteristic during an initialization of the transcription roller, the power source selecting one of the second characteristics based on the transcription voltage and the transcription current measured during the initialization period, the power source providing power to the transcription roller during a normal operation of the transcription roller based on the selected one of the second characteristics.

The present invention also provides a method for forming an electrostatic latent image on a recording sheet comprising the steps of applying a first power source having a first characteristic to a transcription roller and measuring a transcription voltage and a transcription current during an initialization period, selecting one of a plurality of second characteristics based on the measured transcription voltage and measured transcription current, and applying a second power source having the selected one of the second characteristics to the transcription roller during an operational period.

In accordance with an electrostatic imaging device and a method of the present invention, the measured transcription voltage and transcription current in the initialization can provide a resistivity of the toner layer, based on which suitable ambient conditions for the power source can be obtained. Thus, the selected one of the second characteristics provides a suitable characteristic of the power source adapted for the ambient conditions without using a thermal sensor and a humidity sensor.

The above and other objects, features and advantages of the present invention will be more apparent from the following description, referring to the accompanying drawings.

PREFERRED EMBODIMENTS OF THE INVENTION

Figure 1:
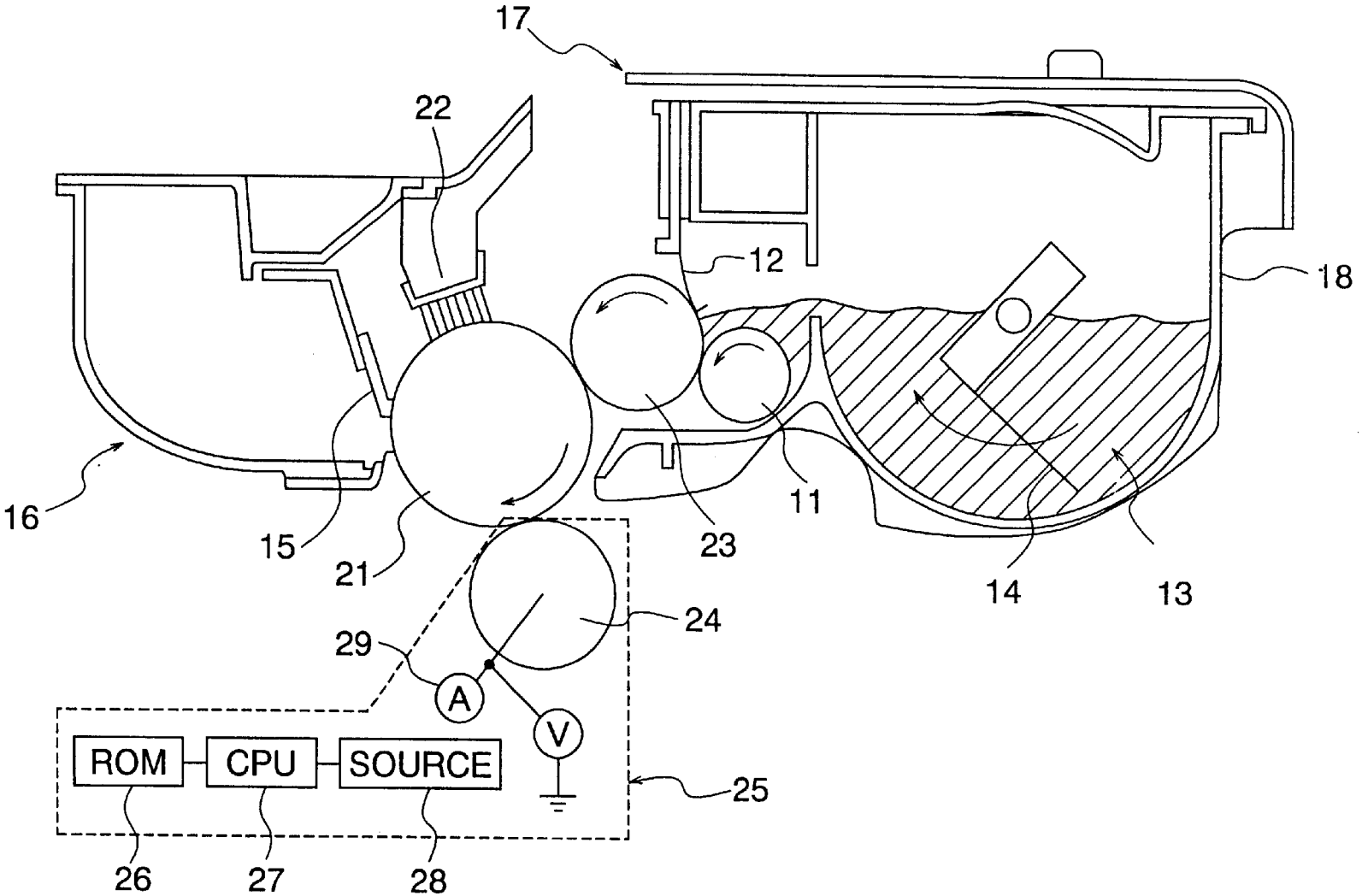
FIG. 1 is a schematic sectional view of an electrostatic imaging device according to an embodiment of the present invention.

Now, the present invention is more specifically described with reference to the accompanying drawings. Referring to FIG. 1, an electrostatic imaging device according to an embodiment of the present invention includes a photoreceptor drum 21 for carrying an electrostatic latent image while rotating in a clockwise direction, an electrification unit 22 for electrifying the photoreceptor drum 21 by applying an electric charge, an exposure unit (not shown in the figure) for exposing the photoreceptor drum 21 to form the electrostatic latent image thereon, a toner collector 16 for collecting the toner remaining on the photoreceptor drum 21 by using a scraping member 15, a development unit 17, and a transcription section 25.

The development unit 17 has a developing roller 23, a housing 18 for receiving therein toner 13, a feed roller 11 for supplying the toner 13 from the housing 18 to the developing roller 23, and a filming member 12. A toner stirring member 14 is provided in the housing 18 for rotation in the clockwise direction. The developing roller 23 rotates in the counterclockwise direction while being in contact with the photoreceptor drum 21, to supply a thin layer of toner to the electrostatic latent image formed on the photoreceptor drum 21. The filming member 12 forms the toner layer on the developing roller 23 and restricts the amount of toner adhered to the developing roller 23 and the electric charge on the developing roller 23.

The transcription section 25 includes a transcription roller 24 rotating in contact with the photoreceptor drum 21, a voltmeter 30 for measuring the transcription voltage applied to the transcription roller 24, an ammeter 29 for measuring the transcription current applied to the transcription roller 24, ROM 26, CPU 27, and a transcription power source 28 operating with a current characteristic stored in ROM 26 and supplied therefrom.

The transcription roller 24 transcribes the toner image from the surface of the photoreceptor drum 21 onto the recording sheet passing through the contact area of the transcription roller 24 with the photoreceptor drum 21. ROM 26 stores data for a first characteristic pattern for the transcription power source in which the relationship between the transcription voltage V (kV) and the transcription current I ($\mu$A) is as follows:

$$I/a+V/b=1,$$

wherein both "a" and "b" are constants larger than zero. In this configuration, the actual voltage and the actual current are further defined by the resistivity of the toner layer. ROM 26 further stores data for a plurality (three) of second characteristics provided for three different ambient conditions, one of which is to be selected for operation of the transcribing roller 24 based on the measured ambient conditions.

CPU 27 controls the overall operation of the device. CPU 27 first starts the device including the transcription roller 24 for initialization of operation based on the first characteristic pattern read from ROM 26, then determines in which range the transcription voltage and the transcription current measured by the voltmeter 30 and the ammeter 29 reside in the first characteristic pattern, and selects one of the second characteristic patterns to be used for printing based on the measured ambient conditions as detailed below.

Figure 2:
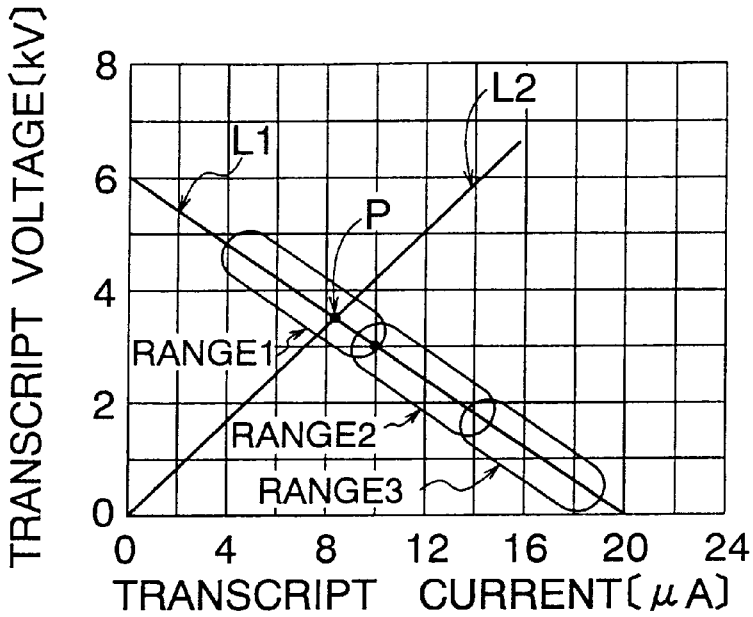
FIG. 2 is a graph showing a first characteristic of the power source applied during initialization between the transcription current and the transcription voltage.

Referring to FIG. 2, the first characteristic I/a+V/b=1 is represented by a line L1 passing the coordinates (0 $\mu$A, 6 kV) and (20 $\mu$A, 0 kV). The first characteristic includes three printing ranges including first range between coordinates (4 $\mu$A, 4.8 kV) and (10 $\mu$A, 3 kV), second range between coordinates (10 $\mu$A, 3 kV) and (14.8 $\mu$A, 1.6 kV), and third range between coordinates (14.8 $\mu$A, 1.6 kV) and (19 $\mu$A, 0.2 kV). The actual transcription voltage and the transcription current are defined also by a line L2 having a slope corresponding to the resistivity of the toner under the present ambient condition and passing through the origin (O) of the coordinates. The actual transcription voltage and the actual transcription current are presented by the coordinates of the point P at which the line L2 crosses with the line L1 defined by the first characteristic.

If the temperature and the relative humidity are 10° C. and 20%, for example, the transcription roller operates in the first range during initialization due to a high resistivity of the toner, or a large slope of L2. If the ambient temperature and the relative humidity are 20° C. and 50%, for example, the transcription roller operates in the second range due to the moderate resistivity of the toner layer. If the ambient temperature and the relative humidity are 32.5° C. and 80%, respectively, the transcription roller operates in the third range due to a low resistivity of the toner layer.

Figure 3:
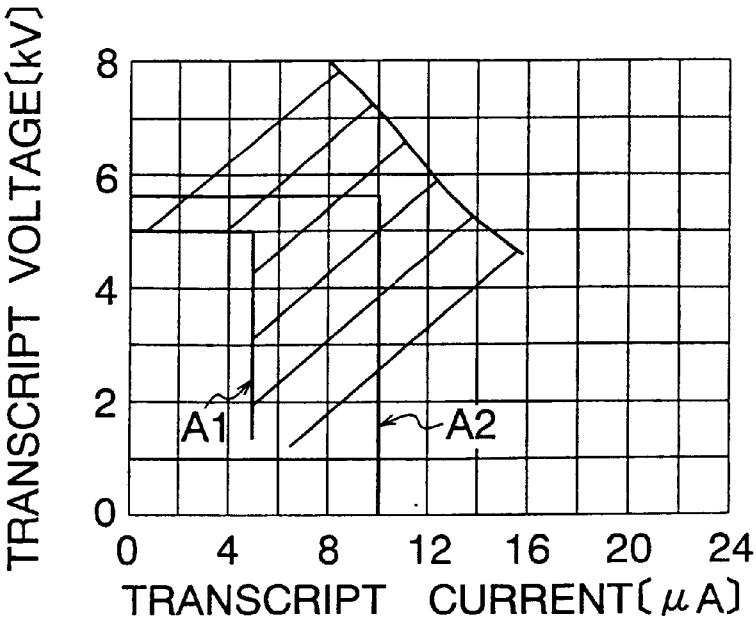
FIG. 3 is a graph showing one of a plurality of second characteristics of the power source under a low temperature and low humidity condition.

Referring to FIG. 3, it is known that the hatched range is suitable for operating the transcription roller at a temperature of 10° C. and a relative humidity of 20% which correspond to the first range in FIG. 2. If the transcription voltage and the transcription current measured by the voltmeter and the ammeter resides in the first range, the CPU reads the data corresponding to FIG. 3 and controls the transcription roller based on FIG. 3. That is, the transcription roller is operated while adjusting the transcription voltage and the transcription current specified between line A1 and line A2, and basically based on the constant current characteristic or constant voltage characteristic. For example, if the transcription current is 10 $\mu$A in the initializing operation, which means that the transcription roller is subjected to a low temperature and low humidity condition, the transcription current is maintained at a constant of 10 $\mu$A along line A2 up to a transcription voltage of 5.5 kV based on the constant current characteristic, and then decreases toward zero with the transcription voltage maintained at 5.5 kV based on the constant voltage characteristic.

Figure 4:
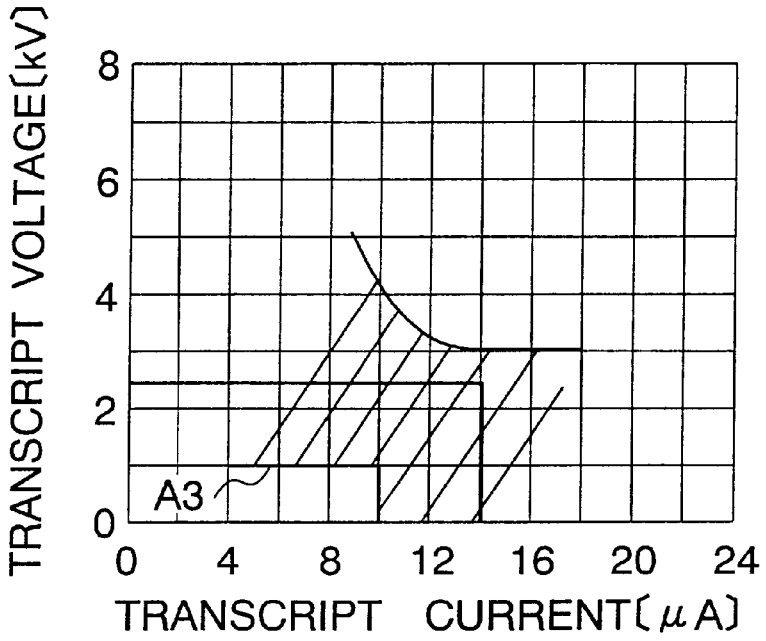
FIG. 4 is a graph showing another of the second characteristics of the power source under a normal condition.

If the transcription voltage and the transcription current measured by the voltmeter and the ammeter reside in the second range during the initialization, the CPU reads the data corresponding to FIG. 4 and controls the transcription roller based on FIG. 4. That is, the transcription roller is operated while the transcription voltage and the transcription current are adjusted between line A3 and line A4, and basically based on the constant current characteristic or constant voltage characteristic. For example, if the transcription current measured in the initialization operation is 14 $\mu$A, which means that the transcription roller is under a moderate ambient condition, the transcription roller is controlled based on FIG. 4, with the transcription current maintained at a constant of 14 $\mu$A along line A4 up to a transcription voltage of 2.5 kV, and then the transcription voltage is maintained at a constant of 2.5 kV down to a transcription current of 6 $\mu$A based on the constant voltage characteristic.

Figure 5:
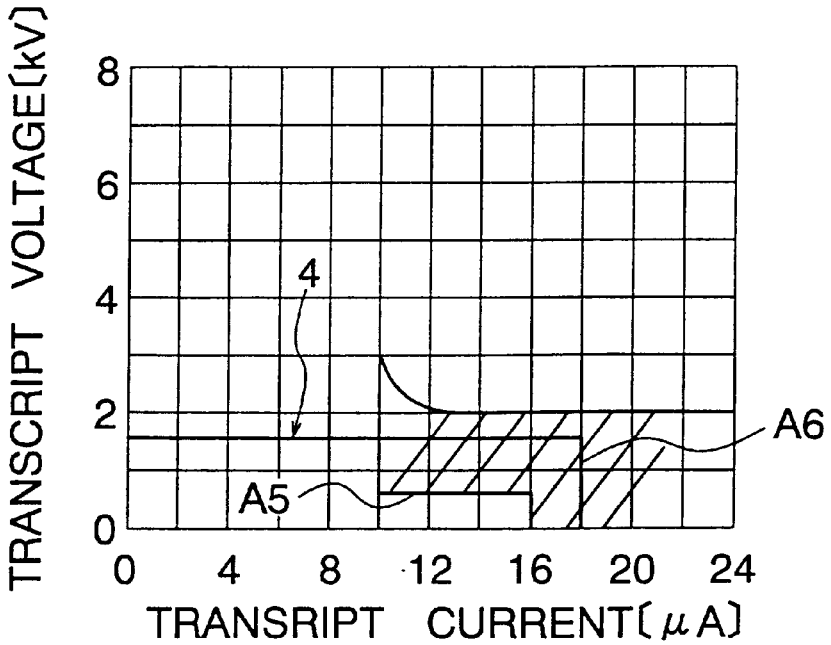
FIG. 5 is a graph showing another of the second characteristics of the power source under a high temperature and high humidity condition.

If the transcription voltage and the transcription current measured by the voltmeter and the ammeter are in the third range, the CPU reads the data corresponding to FIG. 5 and controls the transcription roller based on FIG. 5. That is, the transcription roller is operated while the transcription voltage and the transcription current are adjusted between line A5 and line A6, and basically based on the constant current characteristic or constant voltage characteristic. For example, if the transcription current measured in the initialization operation is 18 $\mu$A, which means that the transcription roller is subjected to a high temperature and high humidity condition, the transcription roller is operated for printing while being controlled based on FIG. 5, with the transcription current maintained at a constant of 18 $\mu$A along line A6 up to a transcription voltage of 1.5 kV, and then the transcription voltage is maintained at a constant of 1.5 kV along line A6 down to a transcription current of 12 $\mu$A.

As described above, in the electrostatic imaging device according to the present embodiment, before the recording sheet enters the contact area of the photoreceptor drum 21 with the transcription roller 24 during an initialization operation of the transcription roller 24, a suitable combination of the transcription voltage and the transcription current can be obtained, without using a thermal sensor or a humidity sensor. Thus, location of the sensors need not be determined during the design of the device, as a result of which the number of design choices can be increased and the number of steps in the design can be reduced.

Since the above embodiments are described only as examples, the present invention is not limited to the above embodiments and various modifications or alterations can be easily made therefrom by those skilled in the art without departing from the scope of the present invention.

What is claimed is:

1. An electrostatic imaging device comprising:

a photoreceptor drum for carrying thereon a toner layer having an electrostatic latent image;

a transcription roller for transcribing said toner layer onto a recording sheet;

a power source for providing a transcription voltage and transcription current to said transcription roller;

a voltmeter for measuring said transcription voltage;

an ammeter for measuring said transcription current; and a ROM for storing a first data for a first characteristic between said transcription voltage and transcription current and a second data for a plurality of second characteristics between said transcription voltage and said transcription current, said power source providing electrical power to said transcription roller based on said first characteristic during an initialization of said transcription roller, said power source selecting one of said second characteristics based on said transcription voltage and said transcription current measured during said initialization period, said power source providing power to said transcription roller during a normal operation of said transcription roller based on said selected one of said second characteristics.

2. The electrostatic imaging device as defined in claim 1, wherein said first characteristic is expressed by:

$$I/a+V/b=1,$$

wherein I and V represent said transcription current and said transcription voltage, respectively, and "a" and "b" are constants larger than zero.

3. The electrostatic imaging device as defined in claim 1, wherein each of said second characteristics is determined corresponding to specific ambient conditions.

4. The electrostatic imaging device as defined in claim 1, wherein each of said second characteristics is based on a constant current characteristic or on a constant voltage characteristic.

5. A method for forming an electrostatic latent image on a recording sheet comprising the steps of:

applying a first power source having a first characteristic to a transcription roller, said first characteristic being expressed by $$I/a+V/b=1,$$

wherein I and V represent a transcription current and a transcription voltage, respectively, and "a" and "b" are constants which are larger than zero;

measuring said transcription voltage and said transcription current during an initialization period;

selecting one of a plurality of second characteristics based on the measured transcription voltage and the measured transcription current; and applying a second power source having said selected one of said second characteristics to said transcription roller during an operational period.

6. The method as defined in claim 5, wherein each of said second characteristics is determined corresponding to specific ambient conditions.

7. The electrostatic imaging device as defined in claim 5, wherein each of said second characteristics is based on a constant current characteristic or on a constant voltage characteristic.

* * * * *